US010544488B2

(12) United States Patent
Tanada et al.

(10) Patent No.: US 10,544,488 B2
(45) Date of Patent: Jan. 28, 2020

(54) MAGNETIC BODY AND ELECTRONIC COMPONENT COMPRISING THE SAME

(71) Applicant: TAIYO YUDEN CO., LTD., Taito-ku, Tokyo (JP)

(72) Inventors: Atsushi Tanada, Takasaki (JP); Kenji Takashima, Takasaki (JP); Yoko Orimo, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 407 days.

(21) Appl. No.: 15/055,356

(22) Filed: Feb. 26, 2016

(65) Prior Publication Data

US 2016/0254082 A1 Sep. 1, 2016

(30) Foreign Application Priority Data

Feb. 27, 2015 (JP) ..... 2015-038401

(51) Int. Cl.

| | |
|---|---|
| ***C22C 38/02*** | (2006.01) |
| ***C22C 38/00*** | (2006.01) |
| ***C22C 38/34*** | (2006.01) |
| ***C22C 38/06*** | (2006.01) |

(52) U.S. Cl.
CPC ..... *C22C 38/002* (2013.01); *C22C 38/06* (2013.01); *C22C 38/34* (2013.01)

(58) Field of Classification Search
CPC ..... C22C 33/0257
See application file for complete search history.

(56) References Cited

U.S. PATENT DOCUMENTS

| | | | | |
|---|---|---|---|---|
| 8,416,051 | B2 | 4/2013 | Matsuura et al. | |
| 9,030,285 | B2 | 5/2015 | Matsuura et al. | |
| 2013/0082815 | A1* | 4/2013 | Ogawa | H01F 3/08 336/233 |
| 2014/0049348 | A1 | 2/2014 | Matsuura et al. | |

(Continued)

FOREIGN PATENT DOCUMENTS

| | | | |
|---|---|---|---|
| CN | 103493155 | A | 1/2014 |
| CN | 103650074 | A | 3/2014 |

(Continued)

OTHER PUBLICATIONS

A Notification of Reason for Refusal issued by Korean Intellectual Property Office, dated Apr. 14, 2017, for Korean counterpart application No. 1020160021848.

(Continued)

*Primary Examiner* — Christopher S Kessler
(74) *Attorney, Agent, or Firm* — Law Office of Katsuhiro Arai

(57) ABSTRACT

In some embodiments, a magnetic body 1 has soft magnetic alloy grains 11 that contain Fe, M (M is a metal element that oxidizes more easily than Fe), and S, as well as oxide films 12 produced by partial oxidization of the soft magnetic alloy grains 11, wherein the magnetic body 1 has its adjacent soft magnetic alloy grains 11 bonded together at least partially through the oxide films 12, and contains Fe by 92.5 to 96 percent by weight and S by 0.003 to 0.02 percent by weight. The magnetic body can have high levels of both magnetic permeability and volume resistivity, to meet the demand for smaller, higher-performance electronic components.

7 Claims, 1 Drawing Sheet

(56) References Cited

U.S. PATENT DOCUMENTS

| | | | |
|---|---|---|---|
| 2014/0104031 | A1 | 4/2014 | Ogawa et al. |
| 2014/0132383 | A1 | 5/2014 | Matsuura et al. |
| 2014/0139311 | A1 | 5/2014 | Matsuura et al. |
| 2014/0191835 | A1 | 7/2014 | Ogawa et al. |
| 2014/0225703 | A1 | 8/2014 | Otake et al. |
| 2015/0332850 | A1 | 11/2015 | Nishio et al. |

FOREIGN PATENT DOCUMENTS

| | | | |
|---|---|---|---|
| JP | 2002060914 | A | 2/2002 |
| JP | 2006097095 | A | 4/2006 |
| JP | 5626672 | B1 | 11/2014 |
| KR | 20090113314 | A | 10/2009 |
| KR | 20140007962 | A | 1/2014 |
| WO | 2014112483 | A1 | 7/2014 |

OTHER PUBLICATIONS

A First Office Action issued by the State Intellectual Property Office of China dated Jun. 14, 2017 for Chinese counterpart application No. 201610108469.6.

* cited by examiner

MAGNETIC BODY AND ELECTRONIC COMPONENT COMPRISING THE SAME

BACKGROUND

Field of the Invention

The present invention relates to a magnetic body that can be used primarily as magnetic cores for coils, inductors and other electronic components, as well as an electronic component containing such magnetic body.

Description of the Related Art

Inductors, choke coils, transformers, and other electronic components (so-called "coil components" and "inductance components") have a magnetic body constituting their magnetic core as well a coil formed inside or on the surface of the magnetic body. For the material of the magnetic body, Ni—Cu—Zn ferrite and other types of ferrite are generally used.

In recent years, there has been a need for electronic components of this type to accommodate higher current (higher rated current value), and to meet this requirement, switching the material of the magnetic body from the traditionally used ferrites to metal materials is considered. Metal materials include Fe—Cr—Si alloy and Fe—Al—Si alloy whose saturated magnetic flux densities are higher than those of ferrites. On the other hand, the volume resistivities of metal materials are much lower than those of ferrites.

Patent Literature 1 discloses a compacted powdered magnetic core constituted by Fe—Cr—Al alloy powder as its soft magnetic material powder, as well as a manufacturing method thereof.

BACKGROUND ART LITERATURES

[Patent Literature 1] Japanese Patent No. 5626672

SUMMARY

In light of the need for smaller, higher-performance electronic components of late, it is desired that a magnetic body having high levels of both magnetic permeability and volume resistivity be provided. One object of the present invention is to provide such magnetic body. Another object of the present invention is to provide an electronic component containing such magnetic body.

Any discussion of problems and solutions involved in the related art has been included in this disclosure solely for the purposes of providing a context for the present invention, and should not be taken as an admission that any or all of the discussion were known at the time the invention was made.

After studying in earnest, the inventors of the present invention completed the present invention as described below.

According to the present invention, the magnetic body has soft magnetic alloy grains containing Fe, a metal M, and S, as well as oxide films produced by partial oxidization of these soft magnetic alloy grains. The metal M is a metal element that oxidizes more easily than Fe. Adjacent soft magnetic alloy grains are bonded together at least partially through oxide films. This magnetic body contains Fe by 92.5 to 96 percent by weight and S by 0.003 to 0.02 percent by weight, or preferably 0.005 to 0.014 percent by weight.

According to a favorable embodiment, the magnetic body contains Cr and/or Al as the metal M. The total content of Cr and Al is preferably 2 to 6.5 percent by weight. More preferably the magnetic body further contains Si. Preferably the total content of Cr and Al is greater than the content of Si based on weight.

An electronic component having a magnetic core containing such magnetic body is also an embodiment of the present invention.

According to the present invention, low-temperature heat treatment with sulfur added caused thin, stable oxide films to be produced and consequently the magnetic body achieved desired magnetic permeability and volume resistivity. According to a favorable embodiment, anti-corrosion property of the magnetic body also improved, while a small content of Si improved the filling ratio, allowing for production of components suitable for a wider range of applications.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
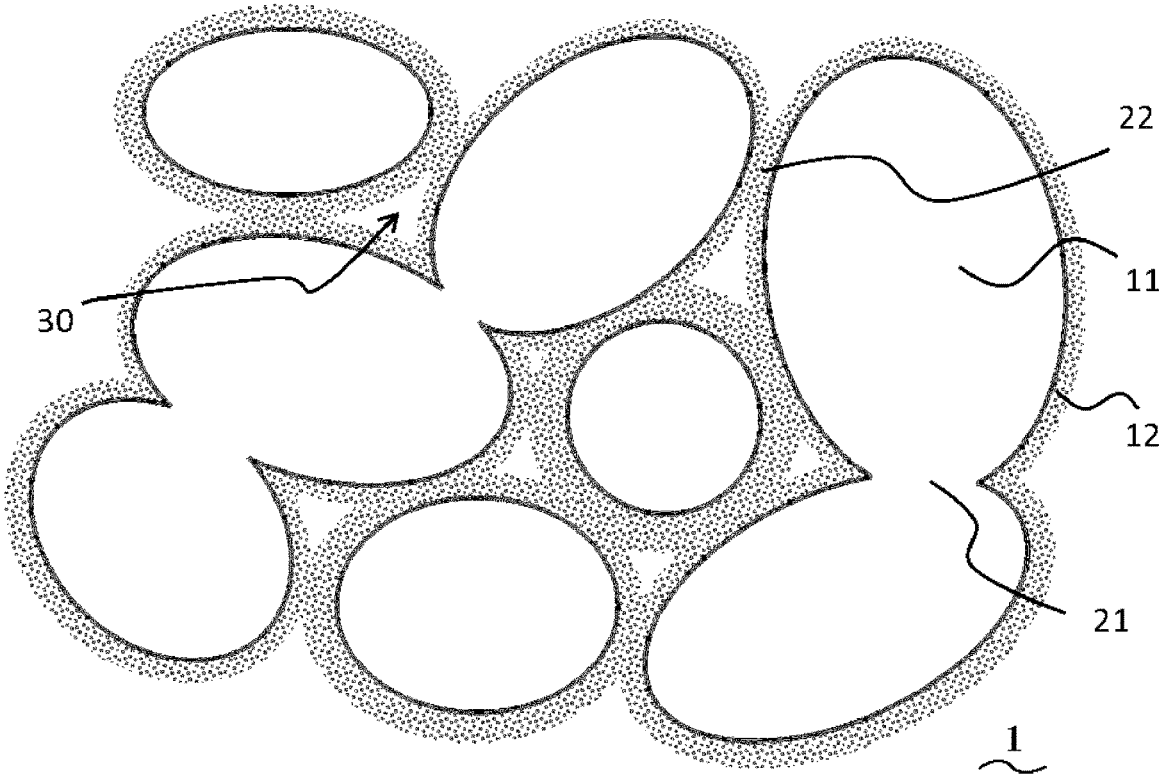
FIG. 1 shows a schematic section view of the microstructure of a magnetic body conforming to the present invention.

1: Magnetic body
11: Soft magnetic alloy grain
12: Oxide film
12*a*: Silicone oxide film
12*b*: Oxide film of metal M
21: Bond between metal grains
22: Bond through oxide films
30: Void

DETAILED DESCRIPTION OF EMBODIMENTS

The present invention is described in detail by referring to the drawings as deemed appropriate. It should be noted, however, that the present invention is not limited to the embodiment illustrated and, because the drawings may emphasize the characteristic parts of the invention, accuracy of scale is not necessarily guaranteed in each part of the drawings.

FIG. 1 is a schematic section view of the microstructure of a magnetic body conforming to the present invention. Under the present invention, a magnetic body 1 as a whole is understood as an assembly of many originally-independent soft magnetic alloy grains 11 bonded together. The magnetic body 1 can also be described as a powder compact constituted by many soft magnetic alloy grains 11. Oxide film 12 is formed at least partially around, or preferably almost all around, at least some of the soft magnetic alloy grains 11, and insulation property of the magnetic body 1 is ensured by this oxide film 12. Adjacent soft magnetic alloy grains 11 are primarily bonded together through the oxide film 12 around each of the soft magnetic alloy grains 11 (refer to symbol 22 in FIG. 1), and the magnetic body 1 having a specified shape is constituted as a result. According to the present invention, adjacent soft magnetic alloy grains 11 may be bonded together partially through their respective metal parts, as indicated by symbol 21. Traditionally used magnetic bodies include those constituted by a matrix of hardened organic resin in which magnetic grains or conjugates of several magnetic grains are dispersed, and others constituted by a matrix of hardened glass component in which magnetic grains or conjugates of several magnetic grains are dispersed. Under the present invention, preferably neither a matrix of organic resin nor matrix of glass component exists in effect.

Individual soft magnetic alloy grains 11 are an alloy containing at least iron (Fe) and a metal element (collectively referred to as "M" under the present invention) that oxidizes more easily than iron, as well as sulfur (S) as an essential component. The metal M is typically Cr (chromium), Al (aluminum), or Ti (titanium), for example, and preferably Cr or Al. Soft magnetic alloy grains may contain Si.

The Fe content in the magnetic body 1 is 92.5 to 96 percent by weight. High volume resistivity is ensured when the Fe content is within the aforementioned range.

The metal M is not limited in any way so long as it is a metal that oxidizes more easily than iron, and preferably it is Cr or Al. Preferably the magnetic body contains Cr or Al or both as the metal M. More preferably the total content of Cr and Al in the magnetic body 1 is 2 to 6.5 percent by weight. Here, the total content of Cr and Al refers to the content of Cr and Al added together if both are contained in the magnetic body 1, and if Cr or Al alone is contained, the term refers to the content of the element contained. If the total content is within the aforementioned range, improvement of anti-corrosion property is expected.

The magnetic body 1 contains S by 0.003 percent by weight or more, or preferably 0.005 percent by weight or more. The upper limit of the content ratio of S in the magnetic body 1 is 0.02 percent by weight, or preferably 0.014 percent by weight. When the content ratio of S, and the aforementioned content ratio of Fe, meet the aforementioned ranges simultaneously, all three of volume resistivity, magnetic permeability, and withstand voltage can be improved at the same time and this consequently helps reduce the electronic component size. In some embodiments, S is incorporated in the magnetic body by adding it as FeS when forming the magnetic body.

Preferably the magnetic body 1 contains silicon (Si). It should be noted that Si is not considered as the metal M as defined above. If Si is contained, the content of Si in the magnetic body 1 is preferably lower than the total content of Cr and Al as described above. In addition, preferably the content of Si is 1 to 4 percent by weight.

The composition of the magnetic body 1 can be calculated by plasma emission analysis. The content of S is measured by combustion/infrared absorption method.

The elements that can be contained other than Fe, Si, and M include Mn (manganese), Co (cobalt), Ni (nickel), Cu (copper), P (phosphorous), and C (carbon), among others. In some embodiments, no non-metal elements such as phosphor and carbon other than sulfur are contained (except those as impurities) in the magnetic body.

Oxide film 12 is formed at least partially around at least some of the individual soft magnetic alloy grains 11 constituting the magnetic body 1. Oxide film 12 may be formed in the material grain stage before the magnetic body 1 is compacted, or it may be kept non-existent or at a minimum in the material grain stage and produced in the compacting process. Preferably the oxide film 12 is constituted by an oxide of the soft magnetic alloy grain 11 itself. In other words, preferably no other material but the aforementioned soft magnetic alloy grains 11 is added for the formation of oxide film 12. Preferably when the soft magnetic alloy grains 11 are heat-treated to obtain the magnetic body 1 before compacting, the surface of soft magnetic alloy grains 11 is oxidized and oxide films 12 are produced so that multiple soft magnetic alloy grains 11 are bonded together through the oxide films 12 thus produced. Existence of oxide film 12 can be recognized as contrast (difference in brightness) in an image of around 10000 magnifications taken by a scanning electron microscope (SEM). Insulation property of the magnetic body as a whole is guaranteed by existence of oxide film 12.

Figure 2:
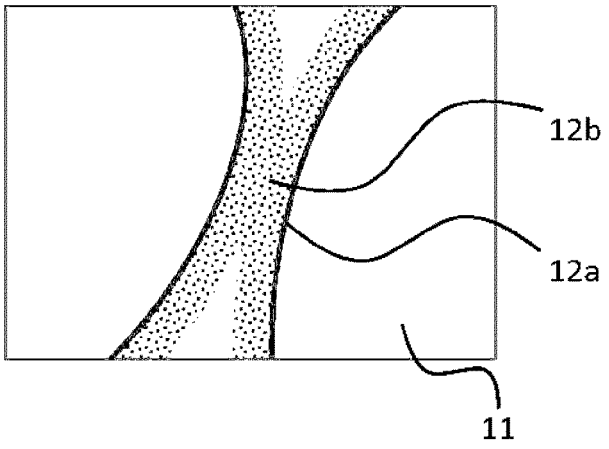
FIG. 2 shows an enlarged view of oxide films in FIG. 1.

As shown in FIG. 2, as far as the oxide film 12 is concerned, preferably silicon oxide film or silicon rich oxide film is formed on the surface of soft magnetic alloy grains 11. In some embodiments, the oxide film is constituted substantially by or consists essentially of silicon and oxygen in principle; however, when its thickness is around 50 nm, other components such as Fe and M may be detected as secondary or minor components by composition analysis due to influence from adjacent layers. Silicon oxide film 12*a* contains more Si than does the soft magnetic alloy grain 11. Furthermore, by adjusting the amount of S to a range of 0.003 percent by weight to 0.005 percent by weight, a range of 0.005 percent by weight to 0.014 percent by weight, and a range of 0.014 percent by weight to 0.020 percent by weight, the silicon oxide film 12*a* can be kept to a range of 5 nm to 10 nm, a range of 10 nm to 50 nm, and a range of 50 nm to 100 nm, respectively. By keeping to these thickness ranges, a film that is thin and covers the metal grain surface can be obtained.

Furthermore, oxide film of metal M 12*b* is formed on the surface of silicon oxide film 12*a*. In the oxide film of metal M 12*b*, the weight ratio of the aforementioned metal M to the Fe is greater than in the soft magnetic alloy grain 11. Methods to obtain oxide film of metal M 12*b* include, for example, keeping the content of iron oxide as low as possible in the material grains used for obtaining the magnetic body, or keeping the material grains relatively or substantially free of iron oxide, and then oxidizing the surface areas of the alloy by means of heat treatment, etc., in the process of obtaining the magnetic body 1. Through such treatment, the metal M that oxidizes more easily than Fe is selectively oxidized and, consequently, the weight ratio of metal M to Fe in the oxide film 12 becomes relatively greater than the weight ratio of metal M to Fe in the soft magnetic alloy grain 11. That the metal M is contained more than the Fe in the oxide film 12, has the benefit of suppressing excessive oxidization of alloy grains.

The method for measuring the chemical composition of the oxide film 12 in the magnetic body 1 is described below. First, the magnetic body 1 is fractured or otherwise its section is exposed. Next, the surface is smoothed by ion-milling, etc., and its image is taken by a scanning electron microscope (SEM), after which the areas corresponding to oxide films 12 are analyzed by energy dispersive X-ray spectroscopy (EDS) and the result is fed to ZAF calculations. Also, bonds 22 between metal grains through silicon oxide films 12*a* can be recognized by line analysis of the soft magnetic alloy grains 11 under EDS using a scanning transmission electron microscope (STEM), where, in the case of silicon oxide film 12*a*, an amount of silicon exceeding twice the amount detected from the soft magnetic alloy grain determines that it is silicon oxide film 12*a*.

In the magnetic body 1, soft magnetic alloy grains 11 are bonded together primarily through oxide films of metal M 12*b* (film-to-film or oxide-to-oxide bonding, i.e., adhering to each other). Existence of bonds 22 through oxide films of metal M 12*b* can be visually recognized on the outside of silicon oxide films 12*a* present on the surfaces of adjacent soft magnetic alloy grains 11 on, for example, a SEM-observed image enlarged by approx. 5000 times. Existence of bonds 22 through oxide films 12 leads to improved mechanical strength and insulation property. Preferably adjacent soft magnetic alloy grains 11 are bonded together through their respective oxide films 12 throughout the magnetic body 1, but so long as they are bonded this way at least partially, sufficient improvement of mechanical strength and insulation property can be achieved and such mode is also considered an embodiment of the present invention. In addition, soft magnetic alloy grains 11 may be partially bonded together directly, not through oxide films 12 (metal-to-metal bonding, i.e., fused to each other), as denoted by symbol 21. Furthermore, there may be partially a mode where neither bonds 22 of adjacent soft magnetic alloy grains 11 through oxide films 12 nor direct bonds 21 of soft magnetic alloy grains 11 exists, but grains are only physically contacting or close to each other. Furthermore, the magnetic body 1 may partially have voids 30.

In addition, the thickness of silicone oxide film 12*a* and thickness of oxide film of metal M 12*b* can be evaluated according to the methods below.

Si Layer Analysis Method

1) A sectioned scanning electron microscope (SEM) sample cutting through the center of the core is prepared.

2) A SEM is used to randomly extract and select an inter-grain interface separated by oxide film. Whether or not this is a grain interface is determined according to the following procedure. First, an image of the sample is taken and coordinates are set on the sample image in order to create a grid of 100 μm×100 μm squares. Within the coordinates, select only the core area and assign a number to each coordinate, and then generate a random number using a computer to select one square within the coordinates. Divide the selected 100×100 μm square into 1 μm×1 μm squares. Generate a random number using a computer to select one square within the corresponding coordinate. Check for grain interface in the square and if there is no grain interface, generate a random number again and select another square, and repeat this until the selected square contains a grain interface. Select the grain interface inside the selected square.

3) A focused ion beam (FIB) apparatus is used to process and prepare a thin sample in such a way that the grains lie vertical to the interface running through the center of the grains. Such thin sample can be prepared according to the micro-sampling method. The sample is processed to a thickness of 100 nm or less at the metal grain powder area. The sample thickness is measured by the electron energy loss spectrometer equipped with the scanning transmission electron microscope (STEM: JEM-2100F manufactured by JEOL) using the inelastic scattering mean free path of transmitting electrons. Based on a half convergence angle of 9 mrad and take-off angle of 10 mrad for EELS measurement, a corresponding inelastic scattering mean free path of 105 nm is used.

4) Once the sample has been prepared, immediately a STEM equipped with annular dark field detector and energy dispersive X-ray spectroscopy (EDS) detector is used to check whether silicon oxide film is present or not according to the STEM-EDS method, after which the thickness of oxide film is measured using the STEM-high angle annular dark field (HAADF) method. The specifics are as follows. The STEM-EDS measurement conditions are 200 kV of acceleration voltage, 1.0 nm of electron beam diameter, 1 nm/pixel of resolution, and measuring time that gives a total signal intensity value of 25 count or more within a range of 6.22 keV to 6.58 keV at each point in the Fe grain area. A zone where the signal intensity ratio of FeKα line+CrKα line and OKα line is 0.5 or greater is evaluated as oxide film. Since the STEM-EDS method is associated with a widening signal generation zone within the sample, it is not suitable for length measurement. Accordingly, the STEM-HAADF method described below is used for length measurement. The measurement conditions under the STEM-HAADF method include 0.7 nm or less of electron beam diameter, 27 mrad to 73 mrad of acceptance angle, 300000 times of magnification factor, and 0.35 nm/pixel of picture element size. To eliminate the effect of noise, the signal intensity in the image is adjusted to around $1.7\times10^6$ count. To align the magnification factor for length measurement, a magnification factor calibration sample is captured under the same conditions before and after an image is taken, to calibrate the scale. Before each image is taken, the magnification factor is increased to the maximum value and then lowered to the original magnification factor, after which the lens current is adjusted to a specified value (value used when the calibration sample is captured) and the sample height is aligned. Also, an image is taken by scanning the electron beam in the direction of crossing the interface.

5) To reduce the background effect on the STEM-HAADF image, the signal intensity of each picture element in the image is approximated by the sum of the linear function of vertical-direction and horizontal-direction coordinates of the image (f(x)=ax+by) and the result is subtracted from the image.

6) In the STEM-HAADF image, a line segment of approx. 1 μm in length is drawn between metal grains sandwiching the silicon oxide film 12*a* and oxide film of metal M 12*b*, where such zone does not include any vacuum area as determined by the STEM-EDS image, in a direction vertical to the zone, and an image intensity profile is created along this line segment. The line segment vertical to the oxide film of metal M 12*b* is obtained as a straight line which is vertical to an approximated straight line drawn according to the least squares method by extracting the position coordinates of the oxide film of metal M 12*b* from the STEM-EDS signal intensities of oxygen.

7) The intensity profile of the STEM-HAADF image typically consists of three types of intensities, corresponding to the soft magnetic alloy grain 11, oxide film of metal M 12*b*, and silicon oxide film 12*a*, from high to low intensities. This is revealed by comparing against the EDX signal profile. To be more specific, intensity I(x) in the profile is converted to normalized intensity $I^{norm}(x)$ according to the formula below, and judgment can be made within this intensity range:

$$I^{norm}(x)=(I(x)-I^{min})/(I^{max}-I^{min})$$ Formula:

Here, $I^{max}$ represents the maximum value of intensity in the profile, while $I^{min}$ represents the minimum value of intensity in the profile. The soft magnetic alloy grain 11 corresponds to a range of $0.8<I^{norm}(x)\leq 1.0$, oxide film of metal M 12*b* corresponds to a range of $0.2<I^{norm}(x)\leq 0.8$, and silicon oxide film 12*a* corresponds to a range of $0.0\leq I^{norm}(x)\leq 0.2$.

8) The method for obtaining the thickness of silicone oxide film 12*a* and thickness of oxide film of metal M 12*b* from the STEM-HAADF image is as follows. At the center between the soft magnetic alloy grain 11 and silicon oxide film 12*a*, a position where the intensity becomes one half is defined as an interface of the soft magnetic alloy grain 11 and silicon oxide film 12*a*. At the center between the oxide film of metal M 12*b* and silicone oxide film 12*a*, a position where the intensity becomes one half is defined as an interface of the oxide film of metal M 12*b* and silicone oxide film 12*a*. The distance between the interface of the soft magnetic alloy grain 11 and silicone oxide film 12*a* on one hand, and the interface of the oxide film of metal M 12*b* and silicone oxide film 12*a* on the other, gives the thickness of silicone oxide film 12*a*.

9) Similar measurement is performed on a total of 10 inter-grain interfaces in different 100 μm×100 μm squares, and the average thickness of individual oxide films measured for all these grains is taken as the thickness of sample oxide film.

As explained above, the oxide film 12 is constituted by silicone oxide film 12*a* and oxide film of metal M 12*b* and, by forming the silicone oxide film 12 thin, high filling ratio, insulation property, and withstand voltage can be achieved simultaneously and, also by forming the oxide film of metal M 12*b* thicker than the silicone oxide film 12*a*, metal grains are bonded to ensure strength of the magnetic body.

Methods to generate bonds 22 through oxide films 12 include, for example, applying heat treatment at the specified temperature described later in an ambience of oxygen (such as in air) when the magnetic body 1 is manufactured.

Existence of bonds 21 between soft magnetic alloy grains 11 can be visually recognized in a SEM-observed image (photograph of section) enlarged by approx. 5000 times, for example. Existence of bonds 21 between soft magnetic alloy grains 11 leads to improved magnetic permeability.

Methods to generate bonds 21 between soft magnetic alloy grains 11 include, for example, using material grains having less oxide film, adjusting the temperature and partial oxygen pressure as described later in the heat treatment applied for manufacturing the magnetic body 1, and adjusting the filling ratio when the magnetic body 1 is obtained from the material grains.

The composition of the soft magnetic alloy grain used as material (hereinafter referred to as "material grain") is reflected in (substantially the same as) the composition of the magnetic body to be finally obtained. Accordingly, a desired material grain composition can be selected as deemed appropriate according to the composition of the magnetic body to be finally obtained, and a preferred range of material grain composition is the same as the preferred range of magnetic body composition as mentioned above.

The size of an individual material grain is virtually equal to the size of the grain constituting the magnetic body 1 in the magnetic body to be finally obtained. The material grain size d50 is preferably 2 to 30μ in consideration of magnetic permeability and in-grain eddy current loss. The d50 of the material grain can be measured using a laser diffraction/scattering measurement apparatus.

Preferably the magnetic grains used as material are manufactured according to the atomization method. Under the atomization method, the primary materials Fe, Cr (ferrochromium), Si, and FeS (iron sulfide) are added and melted in a high-frequency melting furnace. Here, the weight ratios of primary components and the weight ratio of S are checked.

The weight ratio of S is measured by the combustion/infrared absorption method described later. The result is fed back and FeS is added further to adjust the amount of S so as to achieve the desired final weight ratio of S. Magnetic grains can be obtained from the material thus obtained, according to the atomization method.

Under the aforementioned combustion/infrared absorption method, the measurement sample is burned by heating it to high temperature under flows of pure oxygen inside a high-frequency induction heating furnace. As the sample is burned, sulfur dioxide ($SO_2$) is produced from S, which is then carried out by oxygen flows and its amount is measured by infrared absorption method. As confirmed by the inventors of the present invention, the amount of S could be measured using this method even in the compacted magnetic body, and the composition ratio of each element including S did not change before and after compacting. While the soft magnetic alloy grains 11 are considered to be partially oxidized when heat treatment is applied at the time of compacting, the change in weight ratio was very small, to the point of being negligible.

The method for obtaining a compact from the material grains is not limited in any way, and any known means for manufacturing grain compact can be incorporated as deemed appropriate. The following explains a typical manufacturing method where material grains are compacted under non-heating conditions and then the resulting compact is given heat treatment. The present invention is not limited to this manufacturing method.

To compact material grains under non-heating conditions, preferably organic resin is added as binder. For the organic resin, preferably one constituted by acrylic resin, butyral resin, vinyl resin, etc., of 500° C. or lower in thermal breakdown temperature is used, as it leaves less binder after the heat treatment. Any known lubricant may be added at the time of compacting. Examples of the lubricant include organic acid salts, specifically zinc stearate and calcium stearate. Preferably the amount of lubricant is 0 to 1.5 parts by weight relative to 100 parts by weight of material grains. When the amount of lubricant is zero, it means no lubricant is used. Binder and/or lubricant is added to the material grains as desired and the mixture is agitated and then compacted to a desired shape. At the time of compacting, pressure in a range of 1 to 30 t/cm$^2$, for example, is applied.

A preferred mode of heat treatment is explained.

Preferably the heat treatment is performed in an oxidizing ambience. To be specific, the oxygen concentration during heating is preferably 1% or more, as it facilitates the generation of bonds 22 through oxide films. The upper limit of oxygen concentration is not specified in any way, but one example is the oxygen concentration in air (approx. 21%) in consideration of manufacturing cost, etc. Preferably the heating temperature is 600 to 800° C., as it facilitates the oxidization of soft magnetic alloy grains 11 themselves to generate oxide films 12 and the consequent generation of bonds through these oxide films 12. In order to facilitate the generation of bonds 22 through oxide films 12, preferably the heating time is 0.5 to 3 hours. Additionally, the heat treatment temperature can be lowered to 700° C. or below by adjusting S to a range of 0.003 to 0.02 percent by weight, and the heat treatment time can also be reduced to 0.5 hour or less by adjusting S to a range of 0.005 to 0.014 percent by weight, thereby improving the efficiency of heat treatment. It should be noted that the magnetic body 1 may have voids 30 inside. The silicon oxide film or silicon rich oxide film can be formed when a ratio of Fe to S in the magnetic body is adjusted specifically to the ranges disclosed herein.

The magnetic body 1 thus obtained can be used as a magnetic core for various types of electronic components. For example, an insulating sheathed conductor wire may be wound around the magnetic body proposed by the present invention to form a coil. Or, green sheets containing the aforementioned material grains may be formed using any known method, after which specified patterns may be formed on the green sheets with conductive paste by means of printing, etc., and then the printed green sheets may be stacked together and pressurized and compacted, to which heat treatment is given under the aforementioned conditions, to obtain an electronic component (inductor) having a coil formed inside the magnetic body proposed by the present invention. Besides the above, the magnetic body proposed by the present invention may be used as a magnetic core and a coil may be formed inside or on the surface of the magnetic core, to obtain various types of electronic components. The electronic components may be of various mounting types including the surface mounting type and through-hole mounting type, and for the means of obtaining an electronic component from the magnetic body, the examples described below may be used as reference or any known manufacturing method in the field of electronic components may be incorporated as deemed appropriate.

Examples

The present invention is explained more specifically below using an example. It should be noted, however, that the present invention is not at all limited to the embodiments described in these examples.

(Magnetic Grains)

Soft magnetic alloy grains were prepared according to the atomization method. Under the atomization method, Fe, Cr (ferrochromium), Si, Al and FeS were used as materials. The compositions of soft magnetic alloy grains are listed in Table 1 (unit: percent by weight). These compositions are based on the total of Fe, Cr, Si, and Al accounting for 100 percent by weight, with sulfur (S) added at a specified ratio relative to these primary components totaling 100 percent by weight. The compositions of soft magnetic alloy grains were confirmed by combustion/infrared absorption method for sulfur (S), and by plasma emission analysis for the remaining elements other than S. The average grain size of soft magnetic alloy grains was adjusted to 10 μm.

(Manufacturing of Magnetic Body)

100 parts by weight of these material grains were agitated and mixed with 1.5 parts by weight of PVA binder, to which 0.5 parts by weight of zinc stearate was added as lubricant. Thereafter, the mixture was compacted at a compacting pressure of 6 to 12 tons/cm$^2$ into the shape used for each evaluation as described later. At this time, the compacting pressure was adjusted so that the filling ratio of soft magnetic alloy grains in the magnetic body would become 83 percent by volume. Next, heat treatment was applied for 1 hour at 650° C. in an atmosphere (oxidizing ambience), to obtain a magnetic body.

TABLE 1

| | Fe | Cr | Al | Si | S |
|---|---|---|---|---|---|
| Comparative Example 1 | 91 | 5 | 0 | 4 | 0.001 |
| Comparative Example 2 | 92 | 1.5 | 0 | 6.5 | 0.001 |
| Comparative Example 3 | 91 | 7 | 0 | 2 | 0.003 |
| Comparative Example 4 | 97 | 2 | 0 | 1 | 0.003 |
| Comparative Example 5 | 94 | 4.5 | 0 | 1.5 | 0.025 |
| Example 1 | 92.5 | 6 | 0 | 1.5 | 0.003 |
| Example 2 | 94 | 4.5 | 0 | 1.5 | 0.003 |
| Example 3 | 96 | 3 | 0 | 1 | 0.003 |
| Example 4 | 94 | 0 | 4.5 | 1.5 | 0.003 |
| Example 5 | 95.5 | 3 | 1.5 | 0 | 0.003 |
| Example 6 | 94 | 4.5 | 0 | 1.5 | 0.020 |
| Example 7 | 94 | 4.5 | 0 | 1.5 | 0.014 |
| Example 8 | 94 | 4 | 0 | 2 | 0.005 |
| Example 9 | 94 | 0.5 | 2 | 3.5 | 0.005 |

(Evaluations)

Each magnetic body was checked for sulfur (S) by combustion/infrared absorption method, while the compositions of the remaining elements other than S were measured by plasma emission analysis, and it was confirmed that the composition of the magnetic grain was directly reflected.

Each magnetic body was observed with TEM, and it was confirmed that the magnetic grains were bonded together through the oxide films.

Volume resistivity was measured according to JIS-K6911. To be specific, a disk-shaped magnetic body of 09.5 mm in outer size and 4.2 to 4.5 mm in thickness was manufactured as a measurement sample. During the aforementioned heat treatment, Au film was formed by means of sputtering on both of the disk-shaped bottom surfaces (entire bottom surfaces). Voltage of 25 V (60 V/cm) was applied to both Au film surfaces. The resulting resistivity was used to calculate the volume resistivity.

To measure magnetic permeability μ, a toroidal magnetic body of 14 mm in outer diameter, 8 mm in inner diameter, and 3 mm in thickness was manufactured. A coil constituted by urethane-sheathed copper wire of 0.3 mm in diameter was wound around this magnetic body for 20 turns, to obtain a measurement sample. An L chromium meter (4285A manufactured by Agilent Technology) was used to measure the magnetic permeability of the magnetic body at a measurement frequency of 100 kHz.

To measure withstand voltage, a disk-shaped magnetic body of Ø9.5 mm in outer size and 4.2 to 4.5 mm in thickness was manufactured as a measurement sample. During the aforementioned heat treatment, Au film was formed by means of sputtering on both of the disk-shaped bottom surfaces (entire bottom surfaces). Voltage was applied to both Au film surfaces and I-V measurement was performed. The applied voltage was gradually raised and when the current density became 0.01 A/cm$^2$, the corresponding voltage applied was considered the breakdown voltage. The sample was ranked C, B, and A when the breakdown voltage was under 25 V, 25 V or above but under 100V, and 100 V or above, respectively.

To evaluate anti-corrosion property, a magnetic body of 09.5 mm in outer size and 4.2 to 4.5 mm in thickness was manufactured. This magnetic body was let stand for 100 hours under high-temperature, high-humidity conditions of 85° C./85%. The outer size of the magnetic body was measured for dimensional change before and after the test, and the sample was ranked A, B, and C when the dimensional change was less than 0.01 mm, 0.01 mm or more but less than 0.03 mm, and 0.03 mm or more, respectively.

The result of each evaluation is shown in Table 2.

TABLE 2

| | Volume resistivity [Ω · cm] | μ | Withstand voltage | Rustproof property |
|---|---|---|---|---|
| Comparative Example 1 | $2.4 \times 10^2$ | 41 | C | A |
| Comparative Example 2 | $6.0 \times 10^1$ | 34 | C | C |
| Comparative Example 3 | $1.2 \times 10^{-1}$ | 44 | C | A |
| Comparative Example 4 | $1.4 \times 10^0$ | 32 | C | B |
| Comparative Example 5 | $5.4 \times 10^7$ | 33 | B | A |
| Example 1 | $3.2 \times 10^4$ | 48 | B | A |
| Example 2 | $2.2 \times 10^5$ | 46 | B | A |
| Example 3 | $2.8 \times 10^5$ | 45 | B | A |
| Example 4 | $8.8 \times 10^6$ | 42 | B | A |
| Example 5 | $3.4 \times 10^4$ | 43 | B | A |
| Example 6 | $9.4 \times 10^6$ | 39 | B | A |
| Example 7 | $6.0 \times 10^6$ | 41 | A | A |
| Example 8 | $9.4 \times 10^5$ | 52 | A | A |
| Example 9 | $7.2 \times 10^6$ | 50 | B | A |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2015-038401, filed Feb. 27, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A magnetic body comprising:

soft magnetic alloy grains that consist of Fe, M (M is a metal element that oxidizes more easily than Fe), and S, and optionally Si, Mn, Co, Ni, Cu, P, and/or C and that are covered with oxide films produced by partial oxidization of the soft magnetic alloy grains;

wherein said magnetic body has its adjacent soft magnetic alloy grains bonded together at least partially through the oxide films, and contains Fe by 92.5 to 96 percent by weight and S by 0.003 to 0.02 percent by weight, and the magnetic body has a volume resistivity (Ω·cm) of $3.2\times10^4$ to $9.4\times10^6$ and anti-corrosion property evaluated as a dimensional change of an outer size of the magnetic body as measured when the magnetic body is let stand for 100 hours under high-temperature, high-humidity conditions of 85° C./85%, which dimensional change is less than 0.01 mm per Ø9.5 mm in outer size of the magnetic body.

2. A magnetic body according to claim 1, containing S by 0.005 to 0.014 percent by weight.

3. A magnetic body according to claim 1, wherein Cr and/or Al is contained as M and a total content of Cr and Al is 2 to 6.5 percent by weight.

4. A magnetic body according to claim 2, wherein Cr and/or Al is contained as M and a total content of Cr and Al is 2 to 6.5 percent by weight.

5. A magnetic body according to claim 3, further containing Si, wherein a total content of Cr and Al is greater than a content of Si based on weight.

6. A magnetic body according to claim 4, further containing Si, wherein a total content of Cr and Al is greater than a content of Si based on weight.

7. An electronic component having a magnetic core that contains a magnetic body according to claim 1.

* * * * *